United States Patent [19]

Schrock

[11] 3,934,278

[45] Jan. 27, 1976

[54] BATHTUB SUPPORT

[75] Inventor: Donald C. Schrock, Nevada, Mo.

[73] Assignee: Crane Co., New York, N.Y.

[22] Filed: Oct. 11, 1974

[21] Appl. No.: 514,277

[52] U.S. Cl. ..... 4/173

[51] Int. Cl.[2] ..... A47K 3/16

[58] Field of Search ..... 4/170, 173, 173 S, 175, 4/177, 187 A

[56] References Cited

UNITED STATES PATENTS

| | | | |
|---|---|---|---|
| 2,122,247 | 6/1938 | Coordes | 4/173 |
| 2,534,147 | 12/1950 | Rodman | 4/173 |
| 3,824,636 | 7/1974 | Brown | 4/170 X |

*Primary Examiner*—Houston S. Bell, Jr.
*Assistant Examiner*—Frederick R. Schmidt
*Attorney, Agent, or Firm*—George S. Schwind

[57] ABSTRACT

An undercarriage or bottom support for a steel bathtub which is attached to the tub bottom by a double stick tape which is positioned between the support and tub bottom.

11 Claims, 4 Drawing Figures

BATHTUB SUPPORT

BACKGROUND OF THE INVENTION

The present invention relates to bathtubs and, in particular, to a novel support means for steel bathtubs which is affixed to the tub bottom by a double stick tape.

Steel bathtubs are usually formed from a single sheet of enameling steel which undergoes several stages of cold pressing to form the desired final configuration. Such bathtubs normally include a front apron which conceals the receptacle or well portion and piping when the bathtub is placed in the bathroom. Upon completion of the forming and drawing of the bathtub into its final configuration, the tub has a thickness of approximately 0.074 inches, dependent upon the thickness of the original sheet of steel. Since steel bathtubs are made of relatively thin sheet steel it is desirable to support the bottom of the tub by some type of struts or channel iron of varying configurations which heretofore have been welded to the underside of the bottom of the bathtub prior to instigating the enameling process. However, welding of such support means to the bottom of the tub causes severe deformation of the inside bottom portion of the bathtub which requires reworking of the well interior to insure satisfactory enameling thereof. Welding often causes permanent deformation in the bottom of the tub due to the stresses that are created by the welding process.

Such reworking of the interior well bottom adds significantly to the cost of the product and in certain instances where damage is extensive it might necessitate scraping of the bathtub. The welding of such support means to the bottom portion of the well also intensifies problems associated with enameling of the tub interior since the support means act as a heat sink when the tub is being enameled, at which time it is an elevated temperature, thus causing unevenness in cooling and inconsistency in the finished enamel. Upon completion of the enameling, the tub is usually coated with a mastic which is sprayed to the bottom of the tub to provide some sound deadening factor.

To eliminate the deformation which occurs during the welding of the support means to the bottom portion of the tub, the present invention is directed to a novel way of affixing the undercarriage or bottom support by means of an adhesive tape. The support means, which is usually channel shaped or of some hollow configuration to reduce the weight factor, has a double stick tape which is affixed to the support means and the support means is then affixed to the tub bottom in the desired location whereby no welding is required. A strong permanent bond between the support and bathtub bottom is thus created which eliminates normal problems heretofore presented with welding and subsequent enameling. Although a moisture proof tape of the closed cell polyolefin foam type may be used in this device, it is understood that other types of tape such as commercially available flexible tapes are also adaptable. In each instance, it is desired that the tape be moisture proof and have an adhesive coating on both of its sides since both sides are used to affix the support means to the bottom portion of the tub. In addition, the tape provides a cushioning effect between the support means and the tub bottom which reduces and practically eliminates the "pop-off" phenomenon which occurs when a tub having a welded undercarriage is dropped on its support whereby the enameling over the welded portion and support will "pop-off". The instant invention also provides a sound deadening factor and absorbs most of the associated noise which is common in steel bathtubs. It is understood that cast iron bathtubs being of much thicker composition and overall weight and rigidity do not need any bottom support means and the sound factor is not prevalent since it is a solid rigid body. Cast iron tubs also incorporate in their mold design rib portions which web between the bottom portion of the tub and the floor and which are integral with the bathtub body.

The main object of the present invention is to provide an improved support means for steel bathtubs whereby the steel support means is affixed to the tub by a double stick tape to thereby eliminate the aforementioned problems which are associated with the heretofore utilized welding of supports to bathtub bottoms, and, to eliminate the ensuing enamel problems also associated with welding.

Another object of the invention is to provide an economical and rigid support means which is low in cost and which is easily affixed to the bottom portion of the tub.

Still another object of the invention is to provide an improved support means for a tub which considerably reduces the sound normally associated in such tubs and therefore provides a sound deadening and cushioning effect for the tub after installation.

Figure 1:
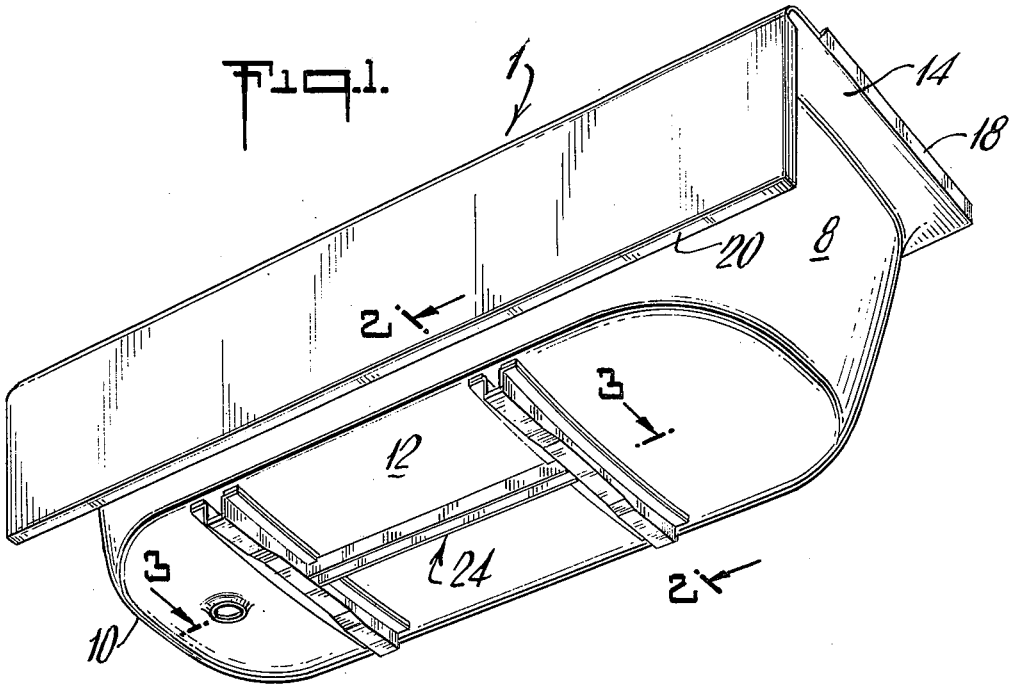
FIG. 1 is a perspective view of the improved support means showing the bottom and apron portion of the tub to which it is affixed.
Figure 2:
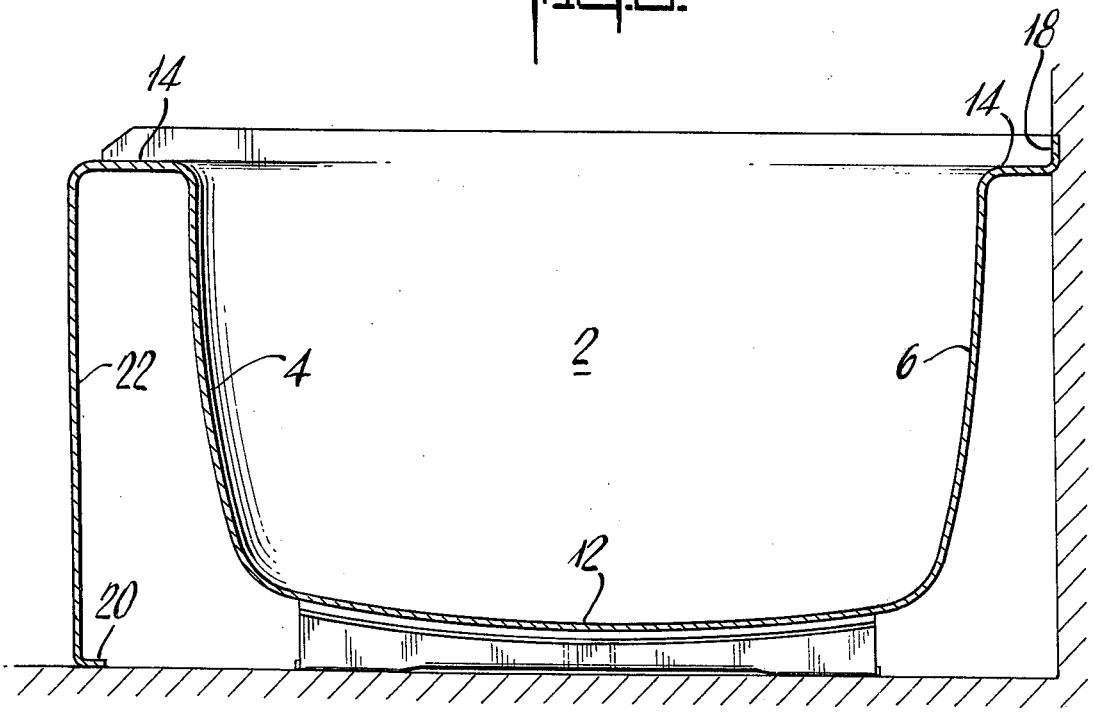
FIG. 2 is a cross-sectional view of the tub and support means taken along lines 2—2 of FIG. 1.

Referring to the drawings by reference characters and, in particular to FIGS. 1 and 2, a steel bathtub generally indicated by reference numeral 1 is formed from a sheet of enameling steel into a configuration which includes a well 2 which is formed by side walls 4, 6, and integral sloping end 8 and the outlet end 10, all of which are integral with the bottom 12. Flange portion 14 extends outwardly and around the end portions 8, 10, and sidewalls 4, 6, in the usual manner. Apron 22 integral with the flange portion 14 in the front of the bathtub conceals the bathtub well 2 and its associated piping, not shown. Tiling flange 18 is provided which extends from the flange portion 14 in proximity to side wall 6 and respective ends 8, 10 to facilitate the insertion of the bathtub 1 into an alcove where it is permanently set and the tile is lapped over the tiling edge 18 in a common well known installation procedure. A reinforcing flange 20 is also projected inwardly from apron 22, as clearly shown in FIG. 1.

The above components represent the usual standard components found in a steel bathtub having an apron which is pressed from a single sheet of enameling steel as clearly shown in FIG. 1.

Figure 3:
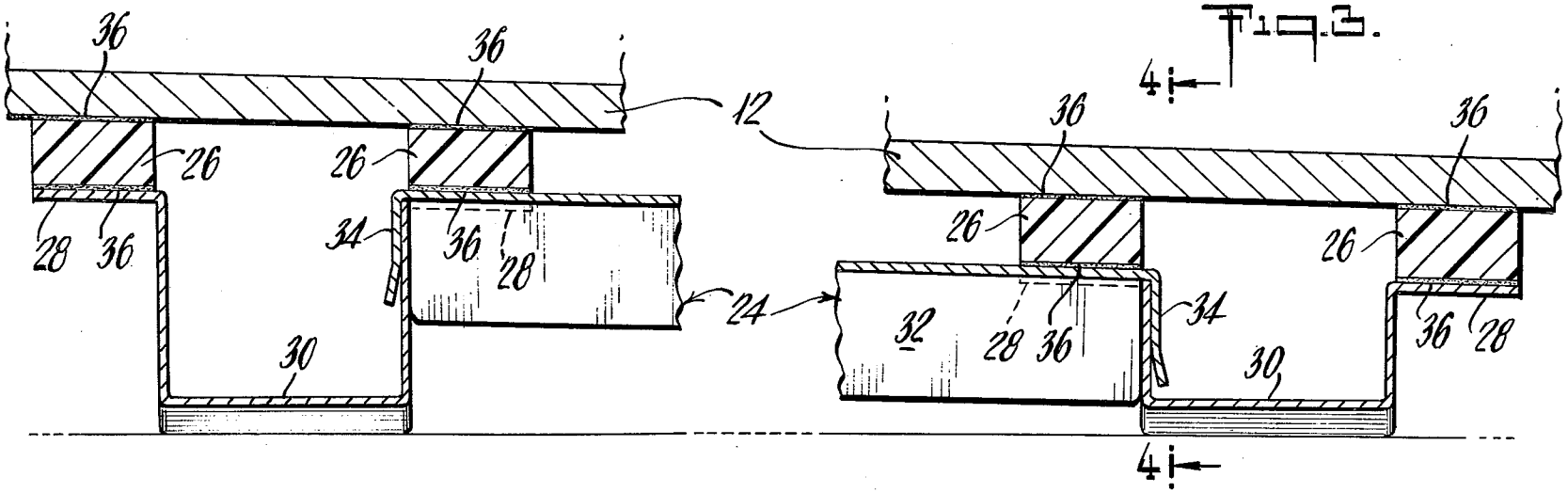
FIG. 3 is a fragmentary cross-sectional view of the support means taken along lines 3—3 of FIG. 1 showing the double stick tape and its relationship to the tub bottom and support means; and, FIG. 4 is a partial cross-sectional view taken along lines 4—4 of FIG. 3.

A bottom support means 24, shown in FIGS. 1 and 3 and which is of generally "H" configuration is affixed to bottom portion 12 of bathtub 1 by means of a double stick tape 26 which is placed between portion 12 and flange portions 28 which extend laterally from a plurality of "U" shaped channels 30 positioned along the length of the bathtub and generally perpendicular thereto.

Channels 30 are spaced from each other at intervals necessary to properly support the bottom portion of the bathtub and the space between said channels is determined by their strength and particular configuration. Channels 30 are joined by channel 32 which overlaps channels 30 by means of overlapping edges 34 as shown in FIG. 3. Thus, channels 30 form the legs of the H configuration and channel 32 forms the crossbar between the two legs. These channels, which can be made integral for convenience, comprise the bathtub support means 24.

Channels 30 have flange portions 28 extending laterally from each side thereof which provide a carrier for the double stick tape 26 inserted between the tub bottom 12 and respective flange portion. Although channel 32, which forms a crossbar between the channels 30, has no flange portions, it is understood that by assemblage could be such that this member being of U shaped configuration could have its base portion in proximity to the bathtub bottom 12 wherein double stick tape could be placed between mating surfaces.

As clearly shown in FIG. 3, the double stick tape 26 may be any of the commercially available types of generally moisture proof tape including the closed cell polyolefin type. Adhesive 36 is placed on both sides of the tape, one of which is in contact with the bathtub bottom 12, the other of which is in contact with respective flange 28. Other types of tape, such as foam neoprene, are also readily acceptable for use in the application as described provided they are of the double stick type. It is understood that the U shaped support struts 30 may be of other desired configurations, such as rectangular hollow elements, and they need not necessarily form an H configuration on the bottom of the tub. It is understood that various types of support elements and various types of tape may be used in various general configurations to support the bottom portion of a steel bathtub as the advantages described completely eliminate the numerous drawbacks found in welding parts of the bottom of the steel bathtub to support means.

Figure 4:
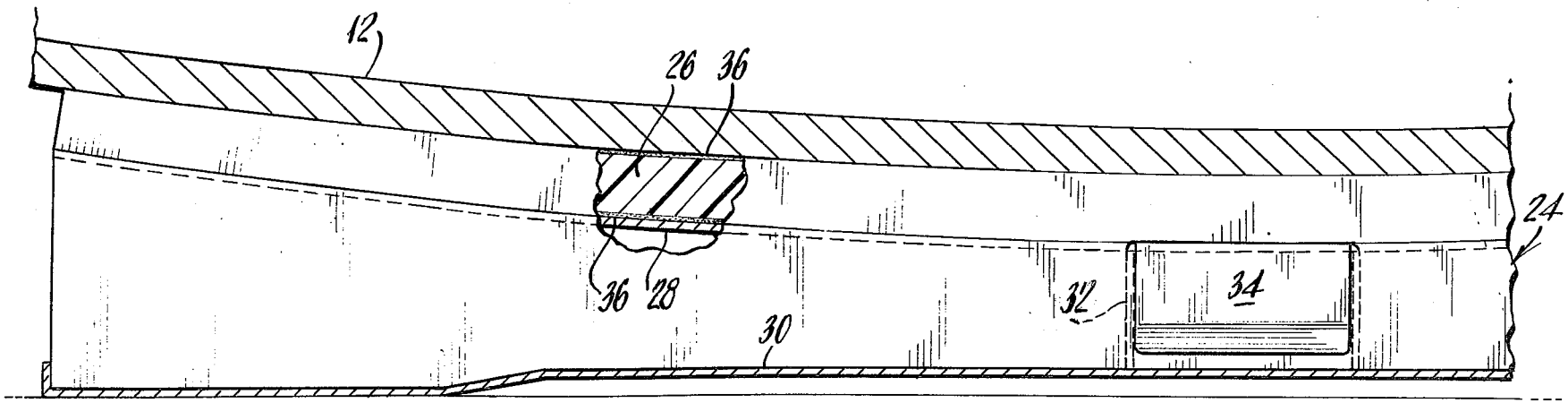

With reference to FIG. 4, this clearly shows the cooperation between the bottom portion 12 of the bathtub whereby the tape 26 is placed along the flange 28 of channel 30 in a manner to not only affix the support means 24 to the bathtub but also to show the novel insertion of such tape whereby the bathtub and support means are isolated from each other by the tape to form an effective sound deadening arrangement. It is highly desirable to deaden the noise factor in steel bathtubs and to reduce the noise transmitted through the bathtub when water is being applied to the tub and it is being used. The insertion of such material, regardless whether it be of the neoprene or polyolefin type, generally enhance the noise reduction factor of such steel bathtubs.

It is apparent to those skilled in the art that other variances and modifications in the invention may be undertaken without departing from the spirit of the invention thereof. It is also apparent that a novel means for providing an undercarriage for a steel bathtub which is economical and which simultaneously eliminates the problems associated with welding such structures to the tub and provides a sound barrier insulation is set forth in the disclosure and appended claims.

I claim:

1. A bathtub including:

a. a pair of side walls;

b. a sloping end and an outlet end;

c. a bottom, said bottom, ends and walls forming an integral well;

d. means to support said bottom; and, e. water resistant tape positioned between said means and said bottom preventing contact between said means and said bottom to simultaneously secure said means to said bottom and form a sound barrier therebetween.

2. A bathtub as recited in claim 1 wherein said tape is of the double stick type having adhesive on both sides.

3. A bathtub as recited in claim 2 wherein said tape is of foam neoprene.

4. A bathtub as recited in claim 1 wherein said tape is of the closed cell polyolefin type.

5. A bathtub as recited in claim 1 wherein said means to support said bottom includes a plurality of members spaced and positioned along said bottom.

6. A bathtub as recited in claim 5 wherein said members are of generally U shaped configuration having laterally extending flanges adapted to receive said tape whereby said tape is confined between the said flanges and said bottom.

7. A bathtub as recited in claim 6 wherein said plurality of members is of generally H shaped configuration along said bottom.

8. A bottom support means for a steel bathtub or the like which is adapted to be secured to the bathtub bottom including:

a. a plurality of channel shaped support means positioned substantially perpendicular to the longitudinal axis of the tub and substantially equi-spaced along its bottom; and, b. a moisture proof tape having adhesive on both sides positioned between said support means and the bathtub bottom preventing contact between said means and said bottom to thereby secure said support means to said bottom, and, form a sound barrier therebetween.

9. A support means as recited in claim 8 wherein said tape is of the closed cell polyolefin type.

10. A support means as recited in claim 8 wherein said tape is of the foam neoprene type.

11. A bottom support means as recited in claim 8 wherein said channel shaped support means are of U shaped configuration having laterally extending flange portions adapted to receive said tape whereby said tape is positioned between said flanges and the bottom of the bathtub.

* * * * *